United States Patent [19]

Singer, deceased

[11] Patent Number: 4,995,994

[45] Date of Patent: Feb. 26, 1991

[54] LUBRICANT

[75] Inventor: Haimi N. Singer, deceased, late of Parktown, South Africa, by Tamara Singer, executor

[73] Assignee: Singer & Hersch Industrial Development, South Africa

[21] Appl. No.: 339,547

[22] Filed: Apr. 17, 1989

[30] Foreign Application Priority Data

Apr. 20, 1988 [ZA] South Africa ..... 88/2768

[51] Int. Cl.[5] ..... C10M 173/02

[52] U.S. Cl. ..... 252/28; 252/25; 252/29; 252/49.3

[58] Field of Search ..... 252/25, 49.3, 28, 29, 252/49.5

[56] References Cited

U.S. PATENT DOCUMENTS 2,258,202 10/1941 Burns ..... 252/29
4,151,099 4/1979 Nassry ..... 252/49.3
4,702,854 10/1987 Snyder ..... 252/49.5

FOREIGN PATENT DOCUMENTS 1088644 9/1960 Fed. Rep. of Germany .
1591652 6/1981 United Kingdom .

*Primary Examiner*—Jacqueline V. Howrad
*Attorney, Agent, or Firm*—Lowe, Price, LeBlanc, Becker & Shur

[57] ABSTRACT

A lubricant composition comprising (a), a water-based lubricant which comprises a substantially oil-free, aqueous, emulsion-free composition of a matter comprising a major amount of water, a minor but effective amount of at least one substantially water-insoluble oil-soluble functional additive stably dispersed therein, and a minor but effective amount of at least one substantially water-soluble, liquid organic dispersing agent which is capable of dissolving the functional additive and of stably dispersing the functional additive in the composition, (b), a particulate solid lubricant suspended in the water-based lubricant and uniformly dispersed therethrough, and (c), a thixotropic thickener which maintains the solid lubricant in suspension in the water-based lubricant.

13 Claims, No Drawings

LUBRICANT

BACKGROUND OF THE INVENTION

This invention relates to a water-based lubricant.

There is available on the market a water-based lubricant which comprises a substantially oil-free, aqueous, emulsion-free composition of matter comprising a major amount of water including up to as much as 99.9 percent by weight of water, a minor but effective amount of at least one substantially water-insoluble, oil-soluble functional additive stably dispersed therein, and a minor but effective amount of at least one substantially water-soluble, liquid organic dispersing agent which is capable of dissolving the functional additive and of stably dispersing the functional additive in the composition.

The composition is formed by premixing the functional additive and the dispersing agent, then adding this mixture to the water. The preferred functional additive is a sulphur- or chlorosulphur- extreme pressure agent, a chlorinated hydrocarbon or phosphorus extreme pressure agent or a mixture of two or more of these agents. The composition can optionally contain at least one water-soluble polymeric thickener.

Lubricants of this type are described and claimed in British Pat. No. 1,591,652.

SUMMARY OF THE INVENTION

According to the present invention, there is provided a lubricant composition comprising:

(i) a water-based lubricant which comprises a substantially oil-free, aqueous, emulsion-free composition of matter comprising a major amount of water, a minor but effective amount of at least one substantially water-insoluble, oil-soluble functional additive stably dispersed therein, and a minor but effective amount of at least one substantially water-soluble, liquid organic dispersing agent which is capable of dissolving the functional additive and of stably dispersing the functional additive in the composition;

(ii) a particulate solid lubricant suspended in the water-based lubricant and uniformly dispersed therethrough; and (iii) a thixotropic thickener which maintains the solid lubricant in suspension in the water-based lubricant.

DETAILED DESCRIPTION OF THE INVENTION

The particulate solid lubricant may be any known in the art such as graphite, molybdenum disulphide, and the like. The preferred particulate solid lubricant is graphite. The particle size off the lubricant will be fine, generally less than 50 microns.

Essential to the invention is that the lubricant composition contains a thixotropic thickener capable of maintaining the particulate solid lubricant in suspension. A thixotropic thickener is one which has a relatively high viscosity which reduces when subjected to shear and returns to a high value on release of the shear.

One example of a suitable thixotropic thickener is an organo clay thickener such that sold under the trade name Bentone.

An example of another suitable thixotropic thickener is that sold under the trade name Veegum. Veegum is a material derived from mineral bases that are members of a series of isomorphous silicates formed by the weathering of glassy volcanic ash, for example a colloidal magnesium aluminium silicate.

The thixotropic thickener will generally be provided in the composition in an amount of 1 to 20%, typically 1 to 10%, based on the water content of the composition.

The composition will typically have a viscosity of at least 600 centipoise.

The amount of particulate solid lubricant present in the composition will generally be 0.1 to 50%, preferably 2 to 20%, by weight of the composition.

The water-based lubricant is of the type described in British Pat. No. 1,591,652, the contents of which are incorporated herein by reference. The functional additive of the water-based lubricant is preferably a sulphur- or chlorosulphur- extreme pressure agent or a chlorinated hydrocarbon or phosphorus extreme pressure agent, or a mixture thereof. Examples of particularly suitable extreme pressure agents are sulphurised oxymolybdenum organophosphoro dithioates and sulphurised oxyzinc organophosphoro dithioates.

The dispersing agent must be capable of dissolving the functional additive. Usually this dispersing agent will dissolve at least 10g of the functional additive, generally at least 50g, per liter of dispersing agent. The dispersing agent is itself water-soluble generally having a solubility in water of a minimum of about 5g per liter in water at 20° C. Examples of suitable dispersing agents are polypropylene glycols.

The water-based lubricant will be formed by pre-mixing the functional additive and the dispersing agent and then adding this mixture to the water.

The lubricant compositions of the invention have particular application to the lubrication of fast moving contacting surfaces, i.e. that is surfaces which are rotating relative to each other at speeds of 50 rpm or more. In particular, the lubricant compositions are useful in gearboxes, differentials, open gear dressings and other such applications where high speeds are encountered between contacting surfaces. It has been found that the particulate solid lubricant adds to the lubricating properties of the water-based lubricant. However, to achieve this, it has been found that the thixotropic thickener is required for if thickeners which are not thixotropic are used the particulate solid lubricant separates out and fails to add to the lubricity of the composition.

The lubricant composition of the invention also has application to the lubricant of drag lines in open cast mining. These drag lines when drawn across the rough surface of an open cast mine are subjected to severe abrasive forces. The lubricant composition of the invention when applied to such drag lines minimises the detrimental effect of such abrasive forces. The composition is preferably sprayed on to the drag line.

The invention will now be illustrated by the following examples.

EXAMPLE 1

A mass of Bentone EW was mixed with water creating a viscous gel. A lubricant composition was then made by assembling the following ingredients in the indicated amount:

| Ingredient | Amount |
|---|---|
| (a) Hydroxy ethyl cellulose (Natrosol LR) | 40 g |
| (b) Zinc dithiophosphate | 2 g |
| (c) A first portion of polypropylene glycol | 1 g |

-continued

| Ingredient | Amount |
|---|---|
| (Pluriol P900) | |
| (d) Molyvan L (Sulphurised oxymolybdenum organophosphoro-dithioate) | 1 g |
| (e) A second portion of polypropylene glycol (Pluriol P900) | 2 g |
| (f) Diethanolamine | 5 g |
| (g) Emulan SH (corrosion inhibitor) | 10 g |
| (h) Ethylene glycol | 50 g |
| (i) Dye | 1 g |

Ingredient (a) was dispersed in 600 ml of water and added thereto was the Bentone EW gel. The composition was allowed to hydrate. The thickened mixture was then cooled two about 5° C. with ice.

Ingredients (b) and (c) were mixed and dispersed well into a portion of the thickened composition. Ingredients (d) and (e) were mixed and dispersed well into the remainder of the thickened composition. The two portions of the thickened composition were recombined and agitated to form a homogeneous dispersion. The remaining ingredients were added individually to the thickened mixture which was agitated after each addition. Finally, a mass of −50 micron graphite powder was added to the thickened mixture and agitated well to disperse it uniformly through the mixture. The amount of graphite in the final composition was 10% by weight. The amount of Bentone EW in the final composition was 5% by weight based on the water content of the composition.

EXAMPLE 2

A lubricant composition was made following the procedure set out in Example 1 and the ingredients of Example 1 except the Bentone EW gel was replaced by the thixotropic thickener, colloidal magnesium aluminium silicate, sold under the trade name Veegum. The amount of Veegum in the composition was 5% by weight based on the water content of the composition.

EXAMPLE 3

The lubricant composition of claim 1 was applied to an open gear dressing used in the rubber industry. The composition was introduced between the rapidly rotating surfaces of the gears. The surfaces were rotating at a speed well in excess of 100 rpm.

The lubricant was found to remove small pit marks on the contacting surfaces of the gears and increased the contact area thereby reducing the friction. Because of the water-base of the composition, the gears could easily be washed with water. In the past, bitumen thickened compositions having been used as a lubricant for these applications. The lubricant composition of the invention not only out-performed the bitumen thickened composition but was also easier to clean and did not give rise to pollution problems.

The lubricant composition of Example 1 was also sprayed on to a drag line in an open cast mining operation and found to reduce substantially the wear on the drag line. Indeed, the lubricant composition out-performed substantially the commonly used mineral grease.

It is claimed:

1. A lubricant composition comprising:

(i) a substantially oil-free, aqueous, emulsion-free water-based lubricant comprising a major amount of water, a minor but extreme pressure agent-effective amount of at least one substantially water-insoluble, oil-soluble functional additive stably dispersed therein, and a minor amount of at least one substantially water-soluble, liquid organic dispersing agent which dissolves and disperses the functional additive in the lubricant;

(ii) a particulate solid lubricant suspended in the water-based lubricant and uniformly dispersed therethrough; and (iii) a thixotropic thickener which maintains the solid lubricant in suspension in the water-based lubricant.

2. A lubricant composition according to claim 1 wherein the particulate solid lubricant is selected from the group consisting of graphite or, molybdenum disulphide.

3. A lubricant composition of claim 1 wherein the particulate solid lubricant is graphite.

4. A lubricant composition according to claim 1 wherein the particle size of the solid lubricant is less than 50 microns.

5. A lubricant composition according to claim 1 wherein the solid lubricant is present in the composition in the amount of 0.1 to 50% by weight of the composition.

6. A lubricant composition according to claim 1 wherein the thixotropic thickener is an organo clay thickener.

7. A lubricant composition according to claim 1 wherein the thixotropic thickener is a material derived from mineral bases that are a series of isomorphous silicates formed by the weathering of glassy volcanic ash.

8. A lubricant composition according to claim 7 wherein the thixotropic thickener is colloidal magnesium aluminium silicate.

9. A lubricant composition according to claim 1 wherein the thixotropic thickener is present in the composition in an amount of 1 to 20% by weight based on the water content of the composition.

10. A lubricant composition according to claim 1 which has a viscosity of at least 600 centipoise.

11. A method of lubricating moving, contacting surfaces comprising the step of applying between the contacting surfaces a lubricant composition comprising:

(i) a substantially oil-free, aqueous, emulsion-free water-based lubricant comprising a major amount of water, a minor but extreme pressure agent-effective amount of at least one substantially water-insoluble, oil-soluble functional additive stably dispersed therein, and a minor amount of at least one substantially water-soluble, liquid organic dispersing agent which dissolves and disperses the functional additive in the lubricant;

(ii) a particulate solid lubricant suspended in the water-based lubricant and uniformly dispersed therethrough; and (iii) a thixotropic thickener which maintains the solid lubricant in suspension in the water-based lubricant.

12. A method according to claim 11 wherein the surfaces form part of a unit selected from gearboxes, differentials or open gear dressings.

13. A method of lubricating a drag line in an open cast mining operation comprising the step of applying to the drag line a lubricant composition comprising:

(i) a substantially oil-free, aqueous, emulsion-free water-based lubricant comprising a major amount of water, a minor but extreme pressure agent-effective amount of at least one substantially water-insoluble, oil-soluble functional additive dispersed therein, and a minor amount of at least one substantially water-soluble, liquid organic dispersing agent which dissolves and disperses the functional additive in the lubricant;

(ii) a particulate solid lubricant suspended in the water-based lubricant and uniformly dispersed therethrough; and (iii) a thixotropic thickener which maintains the solid lubricant in suspension in the water-based lubricant.

* * * * *